United States Patent [19]

Takahashi et al.

[11] 4,278,111

[45] Jul. 14, 1981

[54] APPARATUS FOR MANUFACTURING A WOVEN SLIDE FASTENER STRINGER

[75] Inventors: Kihei Takahashi; Seiko Terada, both of Uozu; Masaatsu Oofusa, Kurobe, all of Japan

[73] Assignee: Yoshida Kogyo, K.K., Tokyo, Japan

[21] Appl. No.: 87,980

[22] Filed: Oct. 25, 1979

[30] Foreign Application Priority Data

Oct. 31, 1978 [JP] Japan ..... 53-134924

[51] Int. Cl.[3] ..... D03D 49/68

[52] U.S. Cl. ..... 139/35; 139/190; 139/442

[58] Field of Search ..... 139/11, 35, 116, 440, 139/442, 188, 190

[56] References Cited

U.S. PATENT DOCUMENTS

| | | | |
|---|---|---|---|
| 3,258,034 | 6/1966 | Gerlack | 139/11 |
| 4,127,147 | 11/1978 | Frohlich | 139/442 |

*Primary Examiner*—Henry Jaudon

*Attorney, Agent, or Firm*—Robert E. Burns; Emmanuel J. Lobato; Bruce L. Adams

[57] ABSTRACT

An apparatus for manufacturing a slide fastener stringer including a woven stringer tape and a coiled fastener element woven into the tape along a longitudinal edge thereof. The apparatus comprises a plurality of harnesses for forming a shed of warp threads, a filling carrier for inserting a weft thread through the warp shed, a first reed for beating the weft thread in the shed against the fell of the tape, means for forming the coiled fastener element to be woven into the tape by the weft thread, and a second reed for beating successive coupling heads of the coiled fastener element one after another against a point which is in alignment with the fell of the tape. The second reed is operatively connected to the first reed so as to synchronize the beating action of the second reed with that of the first reed.

4 Claims, 5 Drawing Figures

APPARATUS FOR MANUFACTURING A WOVEN SLIDE FASTENER STRINGER

BACKGROUND OF THE INVENTION

1. Field of the Invention

The present invention relates to an apparatus for manufacturing a slide fastener stringer including a woven stringer tape and a coiled fastener element woven into the stringer tape along a longitudinal edge thereof.

2. Description of the Prior Art

Apparatus for weaving a stringer tape of warp threads and a weft thread simultaneously with the weaving of a slide fastener element, usually in the form of a helical coil, into the tape are known. In such apparatus the slide fastener element is fed to the weaving area alongside the warp threads and then woven into the tape along a longitudinal edge thereof by the weft thread as the latter is being woven with the warp threads into the tape. The prior apparatus utilize only a single reed which beats the weft thread in the warp shed against the fell of the tape during weaving. However, because such beating force by the reed does not act on the individual coupling heads of the fastener element but only through the medium of the weft thread, the coupling heads of the fastener element on the tape edge are liable to objectionably slant and would often end up with irregular element-to-element pitch. U.S. Pat. No. 3,986,531 issued Oct. 19, 1976 to Lobasov is believed to be one of such prior art apparatus.

SUMMARY OF THE INVENTION

An apparatus of the present invention comprises a first reed for beating a weft thread in each successive warp shed against the fell of a stringer tape, and a second reed for beating successive coupling heads of a coiled fastener element one after another against a point which is in alignment with the fell of the tape. The second reed is operatively connected to the first reed so as to synchronize the beating action of the second reed with that of the first reed.

Accordingly, it is an object of the invention to provide an apparatus for producing a woven slide fastener stringer, which can weave a coiled fastener element into a woven stringer tape such that coupling heads of the coiled fastener element on the tape are free from objectionable slanting and are spaced a uniform distance apart from adjacent coupling heads.

Many other advantages, features and additional objects of the present invention will become manifest to those versed in the art upon making reference to the detailed description and the accompanying drawings in which a preferred structural embodiment incorporating the principles of the present invention is shown by way of illustrative example.

DETAILED DESCRIPTION OF THE PREFERRED EMBODIMENT

Figure 1:
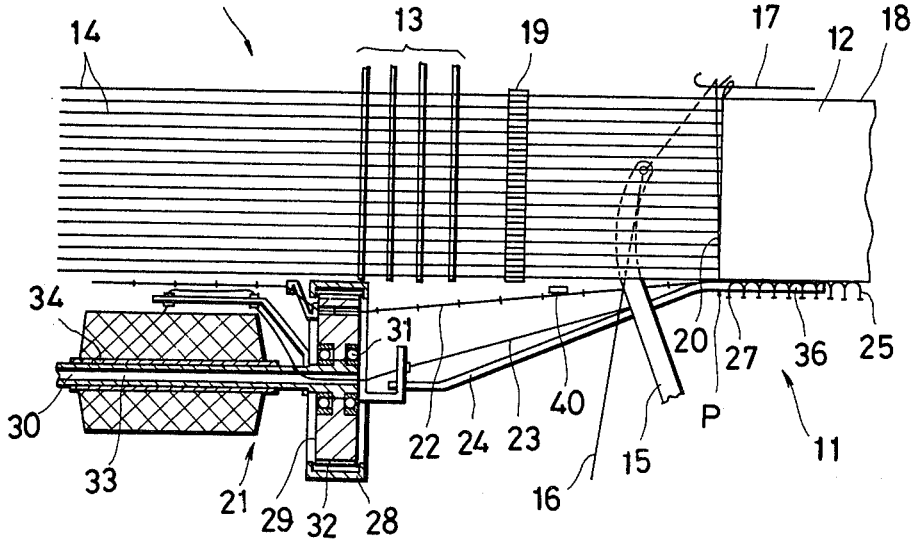
FIG. 1 is a diagrammatic plan view, partly in cross section, of an apparatus constructed in accordance with the present invention, showing a pair of first and second reeds in their retracted positions.

The principles of the present invention are particularly useful when embodied in an apparatus such as shown in FIG. 1, generally indicated by the numeral 10.

The apparatus 10 includes a needle loom 11 of a known construction for producing a narrow, continuous slide fastener stringer tape 12. The needle loom 11 essentially comprises a plurality of harnesses 13 for forming sheds by selectively raising and lowering warp threads 14, a filling carrier 15 for inserting a weft thread 16 through the warp shed, a latch needle 17 reciprocable alongside of one longitudinal edge of the tape 12 for catching and knitting the weft thread 16, carried by the filling carrier, to form a selvedge 18 along said one longitudinal tape edge, and a (first) reed or beating member 19 for beating the weft thread 16 in the warp shed against the fell 20 of the tape 12.

The apparatus 10 further includes a coiling rotor assembly 21 disposed alongside of the warp shed for supplying a monofilament 22 and a core thread 23 and for coiling the monofilament 22 around a mandrel or coiling needle 24 so as to shape the monofilament into a helically coiled fastener element 25 to be disposed along the other longitudinal tape edge remote from the selvedge 18. The monofilament 22 is made of plastic material and has a plurality of widened portions 26 (FIG. 2) spaced at predetermined intervals therealong, such portions 26 being formed as by stamping. The widened portions 26 permit the monofilament 22 to be bent or folded over easily at the portions 26 when the monofilament 22 is being coiled, and alternate widened portions 26 function as coupling heads 27 of the fastener element 25.

The rotor assembly 21 comprises a housing 28 fixed to a base (not shown), a wheel or rotor 29 rotatably mounted in the housing 28, and a floating shaft 30 extending parallel to the warp threads 14 and having a ball bearing 31 around which the wheel 29 is rotatable. The wheel 29 has a set of peripheral teeth 32 with which a drive gear (not shown) meshes for driving the wheel 29. The shaft 30 has a coaxial through hole 33 and supports at one end a bobbin 34 around which the core thread 23 is wound, and at the other end a first guide ring 35 (FIG. 2) located adjacent to the mouth of the shaft hole 33, the core thread 23 being drawn out via a pair of second guide rings 50 (FIG. 2) through the shaft hole 33 and the first guide ring 35 for extending along the mandrel 24.

The mandrel 24 is supported on the shaft 30 and extends therefrom substantially along the warp threads 14 toward the fell 20 of the tape 12, the mandrel 24 having a free end portion 36 extending beyond the fell 20 parallel and adjacent to the longitudinal tape edge that is remote from the selvedge 18. The wheel 29 has a guide hole 37 extending axially therethrough at an eccentric position, for the monofilament 22, supplied from a suitable spool (not shown), to pass therethrough. As the wheel 29 is rotated, the guide hole 37 revolves around the shaft 30, causing the monofilament 22 to turn in a conical orbital path around the mandrel 24.

Figure 3:
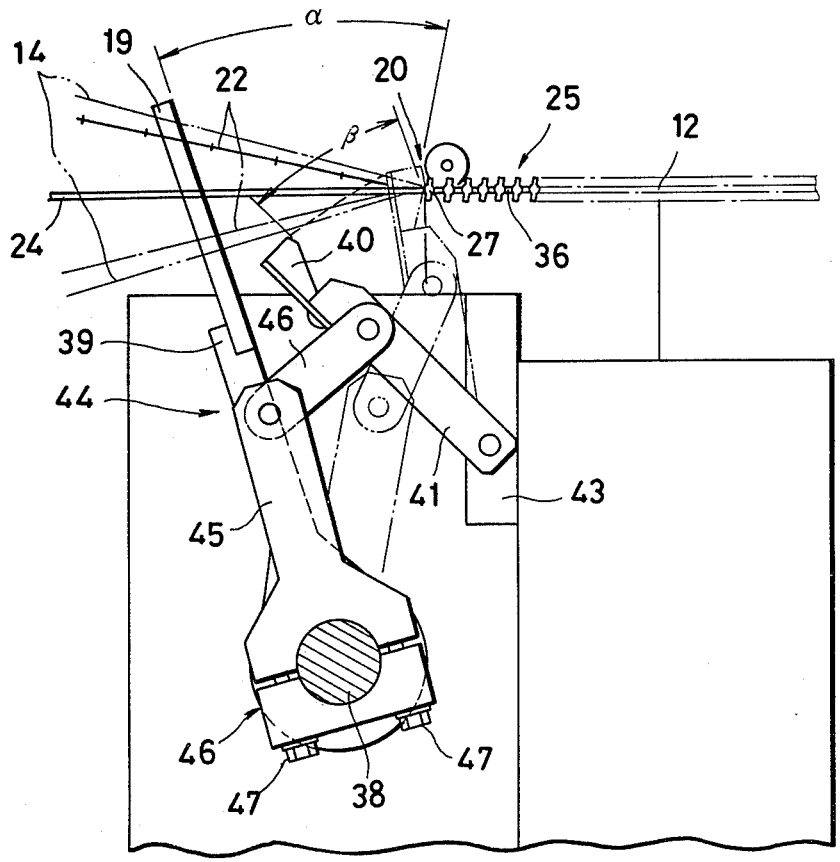
FIG. 3 is a side elevational view, partly in cross section, of a drive mechanism for the first and second reeds.
Figure 4:
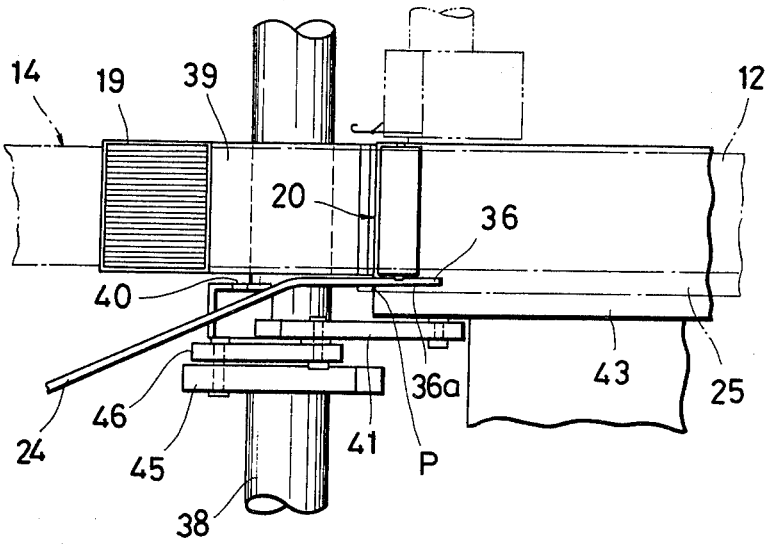
FIG. 4 is a plan view of the drive mechanism of FIG. 3.
Figure 5:
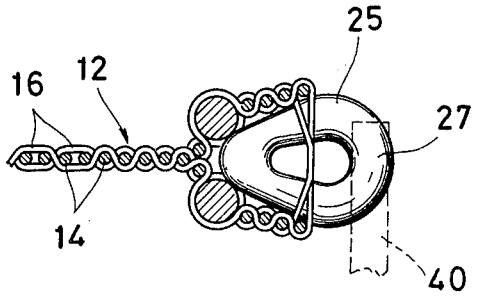
FIG. 5 is a fragmentary, enlarged cross-sectional view of a slide fastener stringer produced with the apparatus according to the invention, showing the manner in which the individual coupling head of a coiled fastener element is beaten by the second reed.

As shown in FIGS. 3 and 4, the first reed 19 is mounted on a shaft 38 through a first arm 39, the shaft being driven by a suitable drive means (not shown) to oscillate through a predetermined first angle $\alpha$ (FIG. 3). Thus, the first reed 19 derives its requisite oscillatory motion from the rocking shaft 38 only via the first arm 39.

The apparatus 10 of FIG. 1 further includes a second reed or beating member 40 for beating the successive coupling heads 27 of the coiled fastener element 25 one after another against a point P (FIGS. 1 and 2) which is in alignment with the fell 20 of the tape 12. As shown in FIGS. 3 and 4, the second reed 40 is carried by a second arm 41 at a free end thereof, the second arm 41 being pivotably supported on a stationary base 43. The second reed 40 is connected to the rocking shaft 38 of the first reed 19 by means of a linkage 44. The linkage 44 comprises a rocking arm 45 mounted on the shaft 38 and a link 46 connected at opposite ends to a free end of the rocking arm 45 and the free end of the second arm 41, respectively. Thus, the second reed 40 derives its oscillatory motion from the rocking shaft 38 via the linkage 44, and such oscillatory motion is synchronous with that of the first reed 19.

The rocking arm 45 is fastened to the shaft 38 of the first reed 19 by a ring-shaped clamp 46 and bolts 47 (FIG. 3) which jointly provide an angular position adjusting means. Accordingly, the rocking arm 45, after loosening of the clamp 46, can be moved angularly about the shaft 38 relatively to the first arm 39, thereby adjusting the angular position of the second reed 40 with respect to that of the first reed 19.

In operation, as the stringer tape 12 is progressively woven of the warp threads 14 and the weft thread 16, the wheel 29 is rotated in timed relation to the reciprocal movement of the filling carrier 15 to coil the monofilament 22 around the mandrel 24 and the core thread 23 to form the coiled fastener element 25, which is then interlaced with the weft thread 16 so as to be woven into the tape 12 along the longitudinal edge thereof that is remote from the selvedge 18. During that time, the rocking shaft 38 is driven to oscillate through a predetermined first angle $\alpha$ (FIG. 3), causing the first reed 19 to oscillate through the same angle $\alpha$ to beat successive picks of the weft thread 16 one after another into the fell of the tape 12. Synchronously with this, the oscillatory motion of the rocking shaft 38 is transmitted to the second arm 41 by the linkage 46. The second reed 40 thus oscillates through a predetermined second angle $\beta$ (FIG. 3) to beat successive coupling heads 27 of the coiled fastener element 25 one after another against the point P (FIGS. 1 and 2) in synchronizm with the beating action of the first reed 19.

Figure 2:
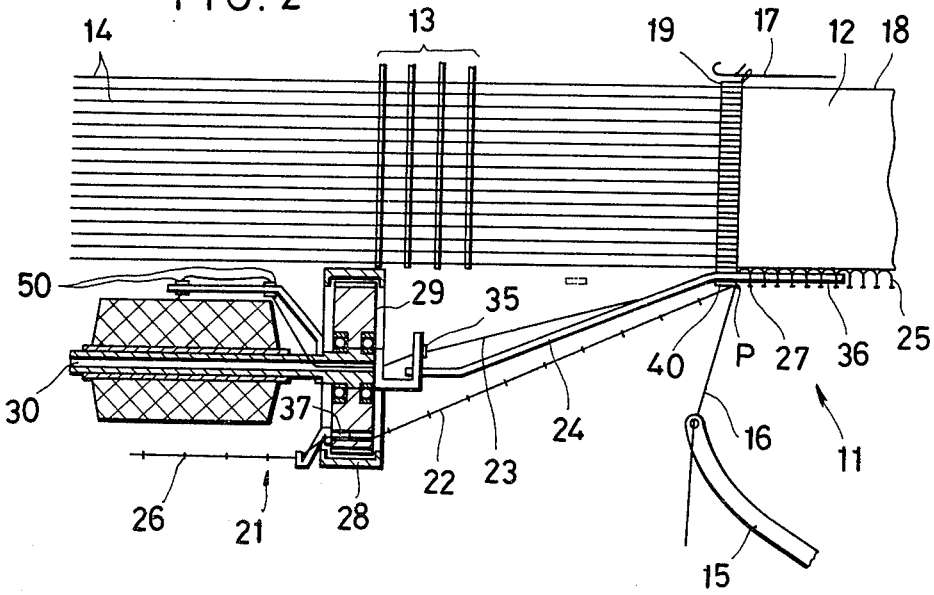
FIG. 2 is a view similar to FIG. 1 but showing the first and second reeds in their beat-up positions.

At the beat-up end (indicated by phantom lines in FIG. 3) of its pivotal path of travel, the second reed 40 moves along the portion 36 of the mandrel 24 on one side 36a (FIG. 4) thereof that is remote from the tape 12, as shown in FIG. 2. And, in its retracted position (solid lines in FIG. 3), the second reed 40 is disposed outside the conical orbital path of the monofilament 22 so that the latter is not obstructed by this reed during coiling operation.

Although various minor modifications may be suggested by those versed in the art, it should be understood that we wish to embody within the scope of the patent warranted thereon, all such embodiments as reasonably and properly come within the scope of our contribution to the art.

What is claimed is:

1. An apparatus for manufacturing a slide fastener stringer including a woven stringer tape and a coiled fastener element woven into the stringer tape along a longitudinal edge thereof, said apparatus comprising:

(a) means for weaving the stringer tape of warp threads and a weft thread, said weaving means including means for forming a shed of the warp threads, means for inserting the weft thread through the warp shed, and first reed means including a shaft rockable through a predetermined angle and a first beating member mounted on said shaft for beating the weft thread in the warp shed against the fell of the tape;

(b) a mandrel for extending substantially along the warp threads, said mandrel having a portion to be located adjacent to the fell of the stringer tape being woven, (c) means for coiling a monofilament on a conical orbital path around said mandrel to form the coiled fastener element to be woven into the stringer tape by the weft thread;

(d) second reed means including a second beating member pivotably between a beat-up position and a retracted position for beating successive coupling heads of the coiled fastener element one after another against a point which is in alignment with the fell of the stringer tape; and (e) connecting means comprising a rocking arm mounted on said shaft of said first reed means and a link connected at opposite ends to said rocking arm and said second beating member for synchronizing the beating action of said second reed means with that of said first reed means.

2. An apparatus according to claim 1, said second beating member, at the beat-up end of its pivotal path of travel, being movable along said portion of said mandrel on one side thereof that is remote from the stringer tape.

3. An apparatus according to claim 1, said second beating member, when retracted, being disposed outwardly of the conical orbital path of the monofilament so that the latter is not obstructed by said second reed during coiling operation.

4. An apparatus according to claim 1, said rocking arm being angularly adjustably mounted on said shaft of said first reed means.

* * * * *